United States Patent [19]

Waltke et al.

[11] Patent Number: 4,921,126

[45] Date of Patent: May 1, 1990

[54] LIQUID SUPPLY SYSTEM UTILIZING STACKED TANKS

[75] Inventors: David L. Waltke; Larry D. Thomas, both of Beatrice, Nebr.

[73] Assignee: Hoover Group, Inc., Alpharetta, Ga.

[21] Appl. No.: 338,195

[22] Filed: Apr. 14, 1989

[51] Int. Cl.[5] ..... B65D 25/00

[52] U.S. Cl. ..... 220/855; 220/85 VS; 220/5 A

[58] Field of Search ..... 220/85 S, 85 VR, 85 VS, 220/5 A

[56] References Cited

U.S. PATENT DOCUMENTS

| | | | |
|---|---|---|---|
| 2,224,903 | 12/1940 | Hooper et al. | 220/85 S |
| 2,530,819 | 11/1950 | Hamlin | 220/5 A X |
| 3,599,660 | 8/1971 | Stickney | 220/85 VR X |
| 4,233,922 | 11/1980 | Conway | 220/85 VS X |
| 4,782,973 | 11/1988 | Wiese | 220/5 A X |

*Primary Examiner*—Steven M. Pollard

*Attorney, Agent, or Firm*—Harness, Dickey & Pierce

[57] ABSTRACT

A supply system is disclosed for continuously supplying a liquid for in-plant use comprising a stationary liquid supply tank connected to an in-plant pumping or receiving system. The liquid supply tank is periodically refilled from a transport tank which is positioned on top of the supply tank and connected to the supply tank via a hose assembly connecting a bottom discharge in the transport tank to a top inlet in the supply tank. A sight tube is provided in the lower supply tank for visualizing the liquid level in the supply tank, and a vapor return tube is provided for removal of vapor from the supply tank to the transport tank as the transport tank contents are drained into the supply tank. Once the contents of the transport tank have been emptied into the supply tank, the transport tank is removed and returned to the liquid supplier for recycling. The supply tank is never completely emptied thereby enabling the flow of liquid to continue uninterruptedly for use in the plant.

8 Claims, 3 Drawing Sheets

LIQUID SUPPLY SYSTEM UTILIZING STACKED TANKS

BACKGROUND AND SUMMARY OF THE INVENTION

This invention relates to a liquid supply system and in particular to a continuous supply system utilizing stacked tanks.

It is not uncommon for an in-plant liquid supply system to consist of a fifty-five gallon drum connected to a pumping or receiving system for drawing liquids from the drum for use as needed in the plant. When the drum is emptied, the pumping or receiving system is disconnected from the drum, the emptied drum moved away and a full drum moved into place and connected to the pumping or receiving system for a continuation of the liquid supply.

Such a system, however, has several disadvantages associated with it. A fifty-five gallon drum typically includes an opening in its top through which a pick-up tube must be inserted to the bottom of the drum for pumping liquids from the drum. During a change from one drum to the next, there is a possibility of leakage from the pick-up tube. In addition, handling of drums often requires manual handling which provides an opportunity for injury to the plant personnel and also for spillage from the drum. During use or changeover of drums, such a system may allow fumes to escape from the drum and may provide a hazard for the plant personnel. Once emptied, a drum must be properly disposed of by the liquid user which may prove to be difficult in the case of hazardous liquids. Another disadvantage with such a system is that during a changeover between drums, the liquid supply is temporarily interrupted.

Accordingly, it is an object of the present invention to provide a continuous liquid supply system without the disadvantages described above.

The liquid supply system of this invention includes a stationary in-plant supply tank which is located at the point of liquid usage. The supply tank is filled in the plant from portable transport tanks which are used for transporting the liquid from the liquid supplier to the user. The in-plant supply tank is positioned at the point of use and connected to the liquid pumping or receiving system through a discharge outlet at the lower end of the supply tank. The transport tank is placed on top of the supply tank and is connected to the supply tank through a lower discharge outlet in the transport tank which is connected to an upper inlet in the supply tank by a transport hose assembly. When the liquid level in the supply tank reaches a predetermined lowered level, the transport tank is emptied into the supply tank. The transport tank is then disconnected from the supply tank, removed from on top of the supply tank, and returned to the supplier for recycling.

The liquid supply system of this invention is advantageous in that it is a closed system, minimizing the possibility of leakage which can occur in the handling of fifty-five gallon drums. The closed system further minimizes the possibility of fumes being released into the plant atmosphere. By employing sloped bottom tanks for the transport tank, waste resulting from the inability to completely empty the tank is virtually eliminated. The tank can be returned to the supplier for recycling so any residual liquid remaining in the tank does not present a disposal concern for the user.

A further advantage of this supply system is that the liquid supply is never interrupted because the supply tank is never completely emptied or disconnected from the pumping or receiving system.

Further objects, features and advantages of the invention will become apparent from a consideration of the following description and the appended claims when taken in connection with the accompanying drawings.

DETAILED DESCRIPTION OF THE DRAWINGS

Figure 1:
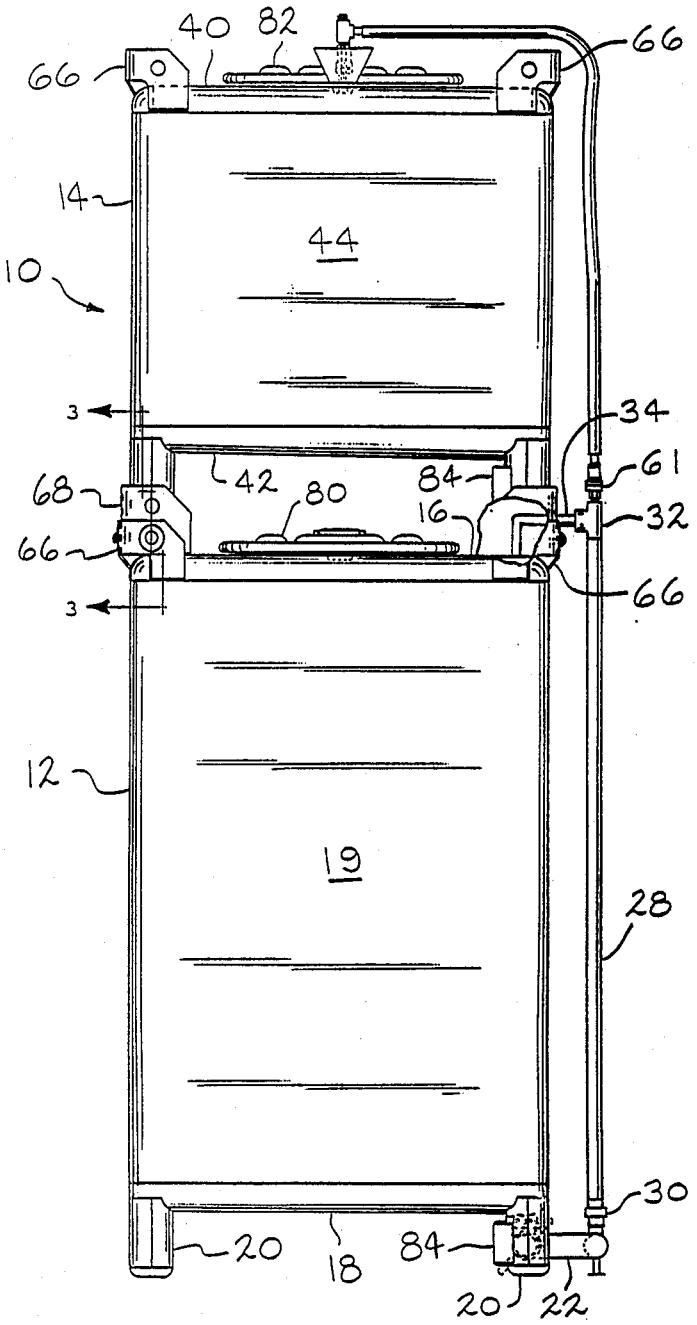
FIG. 1 is a front elevational view of the in-plant supply tank and transport tank of the liquid supply system of this invention.
Figure 2:
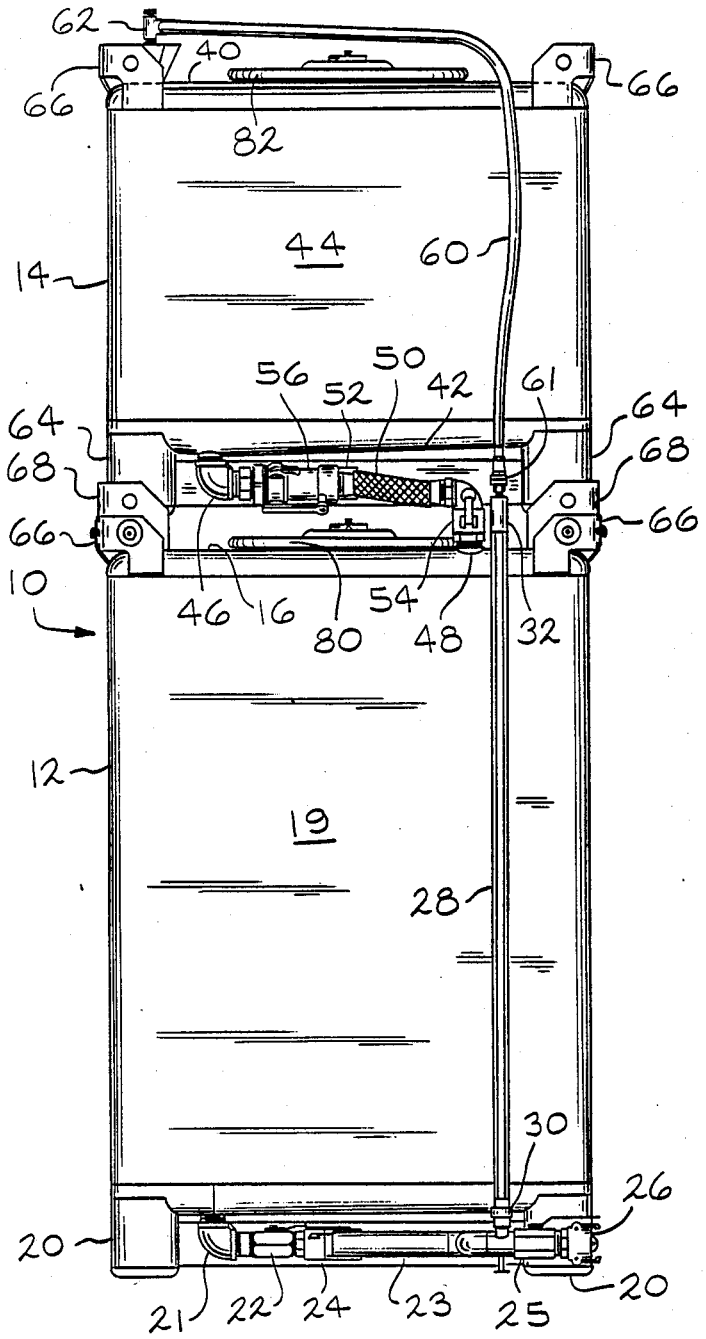
FIG. 2 is a side elevational view of the liquid supply system shown in FIG. 1.

The liquid supply system of this invention is shown in FIG. 1 and designated generally at 10. The liquid supply system 10 includes a lower supply tank 12 and an upper transport tank 14 positioned on top of the lower tank 12. The lower supply tank 12 is positioned in a plant or factory at the point of use of the liquid supplied from the tank. The tank 12 includes a top wall 16, a sloped bottom 18, and a vertical sidewall 19 connecting the top and bottom walls. The tank 12 is supported upon four legs 20 extending downward from the sloped bottom 18 at the four corners of the tank 12. The liquid supply tank 12 includes a liquid discharge outlet 21 in the bottom wall 18 which includes a discharge valve 22 for opening and closing the discharge outlet. A discharge manifold assembly 23 is connected to the discharge valve 22 by a quick connect/disconnect coupling 24. The manifold assembly 23 includes a manifold assembly valve 25 and a quick connect/disconnect coupler 26 which is coupled to the in-plant liquid pumping or receiving system.

A sight tube 28, externally of the tank 12, is connected at its lower end to the manifold assembly by a fitting 30, and connected at its upper end to the interior of the tank 12 through a T-fitting 32 and a connector tube 34 through the supply tank top wall as shown in the broken away portion of FIG. 1.

The transport tank 14 includes a top wall 40, sloped bottom wall 42, and a vertical sidewall 44 connecting the top and bottom walls. The bottom wall 42 is equipped with a discharge outlet 46 which includes a valve 56. A transfer hose assembly 50, having quick connect/disconnect fittings 52 and 54, is used to connect the discharge valve 56 to the inlet 48 in the supply tank top wall 16. When valve 56 is opened, liquid flows from the transport tank into the supply tank by gravity.

A vapor return line 60 is connected to the upper end of the sight tube via a disconnectable fitting 61 into the top of the T-fitting 32. The other end of the vapor return line is connected to the interior of the transport tank 14 through a vapor return bung plug assembly 62 in an opening in the top wall 40 of the transport tank 14.

Figure 3:
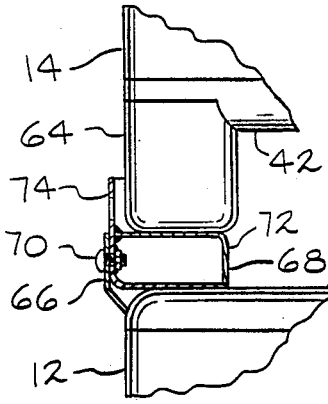
FIG. 3 is a partial sectional view as seen from the line 3—3 of FIG. 1.
Figure 4:
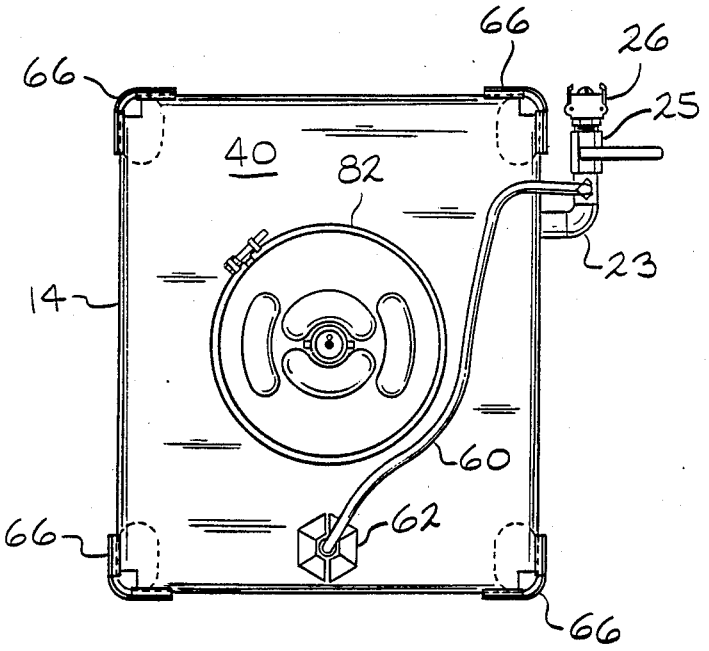
FIG. 4 is a top view of the liquid supply system shown in FIGS. 1 and 2.

Transport tank 14 has support legs 64 at each corner of the bottom wall 42 for supporting the tank 14 thereon. Both tanks include leg receivers 66 at the corners of their top walls which extend upwardly from the top walls. The leg receivers 66 consist of a right angled flange attached to each edge of the tank top wall at each corner forming a corner for reception of the legs from a similar tank, to retain an upper tank in position on top of a lower tank within the leg receivers 66. The supply tank 12 has riser brackets 68 attached to the leg receivers 66 by a bolt 70, FIG. 3. The riser brackets 68 comprise a raised block portion 72 and a leg receiving portion 74 identical to the leg receivers 66 attached to the top of the tanks 12 and 14. The riser block portion 72 is used to support the legs 64 of the transport tank 14 to provide a clearance space between the two tanks for the transport hose assembly 50.

The supply tank 12 includes an opening in the top wall 16 which is closed by a lid 80. Lid 80 normally remains on the tank 12 and is only removed for periodic cleaning or servicing of the tank 12. Likewise, the transport tank 14 includes a similar opening in the top wall 40 which is closed by a lid 82. Lid 82 is removed only for cleaning and servicing of the transport tank.

In operation, the lower in-plant supply tank 12 is placed in the plant at the point of use of the liquid in the tank 12. The discharge manifold 23 of the supply tank is connected to the pumping or receiving system for use of the liquid in tank 12. The liquid level in tank 12 is indicated by a liquid column in the sight tube 28 which has the same height as the liquid level in the tank 12. When the liquid in the tank is depleted to a predetermined level indicated on the sight tube 28, the supply tank 12 is ready for refilling from the transport tank 14. The transport tank 14 is then positioned on top of the supply tank 12. The vapor return line is installed on the vapor return bung plug assembly 62 in the top of tank 14 and connected at the other end to the fitting 32 at the top of the sight tube 28. The discharge outlet 46 of the transport tank is connected to the inlet 48 of the in-plant supply tank via the transfer hose assembly 50. The valve 56 of the discharge outlet 46 is then opened allowing liquid to flow by gravity from the transport tank 14 into supply tank 12. As this occurs, vapor in the tank 12 flows through the vapor return line 60 to the tank 14 enabling a smooth flow of liquid from the tank 14 into the tank 12.

Once the transport tank 14 has been emptied, the valve 56 is closed, the transfer hose assembly 50 disconnected from the discharge outlet 46 and the inlet 48, the vapor return line 60 disconnected from the sight tube and the transport tank 14 removed from the top of the supply tank 12. The tank 14 can then be either properly disposed of or returned to the liquid supplier for recycling. To facilitate safe handling of the tanks 12 and 14 with a fork truck, the legs 20, adjacent the discharge outlets include guards 84. Guards 84 protect the discharge outlets from contact and damage from fork truck tines.

The hose connectors are all snap type, dry break connectors which reduce or eliminate spillage when connected or disconnected to avoid release of possibly hazardous liquids into the plant environment.

The supply system of this invention thus enables the liquid supply to flow uninterrupted from the tank 12 to the point of use of the liquid. Interruption of the liquid flow is not necessary to replenish the liquid supply as in many prior systems utilizing a single tank or drum.

It is to be understood that the invention is not limited to the exact construction illustrated and described above, but that various changes and modifications may be made without departing from the spirit and scope of the invention as defined n the following claims.

What is claimed is:

1. A continuous liquid supply system comprising:

a lower liquid supply tank having top and bottom walls, a side wall connecting said top wall and said bottom wall, and a bottom discharge outlet in said bottom wall for flow of liquid from said lower tank therethrough;

an upper liquid transport tank removably mounted on said lower supply tank;

transfer means removably connecting said upper and lower tanks for transferring liquid from said upper transport tank to said lower supply tank; and vapor return means connected between said lower tank and said upper tank for routing vapors between said tanks as liquid is transferred from said upper tank to said lower tank whereby said upper tank may be installed and removed from said lower tank without interrupting the flow of liquid from said lower tank, said upper tank being used to replenish the contents of said lower tank as the lower tank liquid contents are depleted.

2. The supply system of claim 1 further including sight tube means connected to said supply tank for visually indicating the level of liquid in said lower supply tank.

3. The system according to claim 1 wherein said top wall of said lower supply tank has an opening therethrough for receiving liquid from said upper transport tank and the bottom wall of said lower supply tank is sloped downwardly toward the bottom discharge outlet.

4. The system according to claim 3 further comprising spacer means positioned between said upper and lower tanks for providing a clearance space between said tanks for said transfer hose assembly when said upper tank is mounted on said lower tank.

5. The system according to claim 4 wherein said spacer means comprises at least one metal angle bracket attached to the top of said lower tank upon which said upper tank is supported.

6. The system according to claim 2 wherein the upper transport tank has a top wall with an opening therethrough, a bottom wall with a bottom discharge outlet for flow of liquid from the transport tank therethrough, and a side wall connecting said top and bottom walls, said transfer means comprising a removable transfer hose assembly having a pair of connectable ends, one of said ends being removably connected to said bottom discharge outlet of said upper transport tank, the other of said pair of ends being removably connected to an opening in the top wall of said lower supply tank, said transfer tank discharge outlet further comprising a valve having an open position allowing flow of liquid from said transport tank into said supply tank and a closed position preventing the flow of liquid from said transport tank into said supply tank.

7. The system according to claim 2 wherein said sight tube means comprises an external, generally upright transparent tube having one end communicating with said bottom discharge outlet of said lower supply tank, and one end communicating with the interior of the lower supply tank through the top wall of said lower supply tank.

8. The system according to claim 1 wherein said vapor return means comprises a vapor return tube connected to the upper end of said transparent tube and removably connected to the upper transport tank through said opening in the top wall of said upper transport tank thereby allowing pressure equalization and vapor return between said tanks when said valve is in said open position.

* * * * *